United States Patent [19]

Sullins

[11] 4,355,410

[45] Oct. 19, 1982

[54] INDUSTRIAL X-RAY MACHINE

[75] Inventor: James R. Sullins, Tulsa, Okla.

[73] Assignee: X-Ray Manufacturing & Supply, Inc., Tulsa, Okla.

[21] Appl. No.: 201,178

[22] Filed: Oct. 27, 1980

[51] Int. Cl.[3] ..... H05G 1/02

[52] U.S. Cl. ..... 378/199

[58] Field of Search ..... 250/419, 420, 523

[56] References Cited

U.S. PATENT DOCUMENTS 1,958,191 5/1934 Fryer ..... 250/420

4,264,818 4/1981 Petersen ..... 250/420

*Primary Examiner*—Craig E. Church

*Attorney, Agent, or Firm*—Head, Johnson & Stevenson

[57] ABSTRACT

A completely enclosed, self-contained, air-cooled industrial X-ray machine having a housing which is also a gas-to-gas heat exchanger. The cylindrical metallic housing for the X-ray tube and power transformers is machined to provide a large plurality of narrow radial grooves with intervening narrow vanes on both the inside surface and the outside surface. The outside is covered with a thin-walled cylindrical jacket to provide a plurality of longitudinal passageways. An inside tubular sleeve provides support for the X-ray tube and is adapted to fit closely inside of the inner grooves to provide a plurality of longitudinal passageways on the inner surface. The housing is closed off and sealed with end plates and the interior is filled with a selected heat-transfer and insulating gas at a selected pressure. An internal fan provides circulation of the gas over the X-ray tube and back to the inner longitudinal passageways to the fan. An outside fan circulates room air through the outer longitudinal passageways.

7 Claims, 8 Drawing Figures

INDUSTRIAL X-RAY MACHINE

BACKGROUND OF THE INVENTION

1. Field of the Invention

This invention lies in the field of X-ray machines. More particularly, it concerns industrial X-ray machines which are used on a continuous basis and require positive cooling means to protect the electrical apparatus and the X-ray tube inside the housing.

2. Description of the Prior Art

In the art of continuous duty industrial X-ray machines, one of the most important factors is the cooling system. All of the units which have substantially a hundred percent duty cycle incorporate some kind of remote external heat exchanger. Some use a Freon refrigeration system complete with cooling lines and hoses connected between the cooling unit and the X-ray machine. Others use an oil or water cooling system again complete with inner connecting hoses between the X-ray machine and a small automotive type radiator with fan, etc. Still others simply connect the unit by a water hose to a water tap and use city water pressure to circulate cooling water through the X-ray unit and then down the drain.

These units operate satisfactorily but are heavy, bulky, and are not truly portable, although usually advertised as such. This is because of the hoses and accessories required for cooling. There is no problem with these units when the X-ray machine is installed permanently in a shooting vault and the parts to be radiographed are moved to and from the X-ray unit. The problems arise when the X-ray machine must be used on a cross-country pipeline, moved in and out of pressure vessels in a tank shop, or from one location to another in a foundry.

SUMMARY OF THE INVENTION

It is a primary object of this invention to provide a completely enclosed, self-contained, air-cooled industrial X-ray machine having an improved X-ray tube support means, power supply, and heat exchanger assembly.

It is a further object of this invention to provide a hundred percent duty industrial X-ray machine in which all of the cooling apparatus is mounted inside of the outer envelope of the machine.

It is a still further object of this invention to provide an industrial X-ray machine with improved means for mounting the X-ray unit inside of the housing to provide a shock-proof mounting and to provide improved cooling.

It is a still further object of this invention to provide an industrial X-ray unit which is easily transportable and has no exterior connections, except a power cord from the nearest electrical outlet.

These and other objects are realized and the limitations of the prior art are overcome in this invention by providing a cylindrical housing for the X-ray tube and power transformers in which the housing itself is a gas-to-gas heat exchanger.

The housing is made in circular cylindrical form from a metal which is a good heat conductor, such as aluminum, and is machined with many narrow longitudinal grooves with intervening narrow radial vanes, both on the inside surface of the housing and on the outside surface. These longitudinal vanes extend completely from end-to-end of the housing except for a selected area intermediate the ends, as a port for the X-ray beam. Over this area, which can be a localized rectangular area or can be a completely circumferential area wherein the internal and external vanes are cut away to the base thin-wall tube which provides the strength of the housing.

A thin-walled metallic sleeve is closely fitted over the external vanes so as to provide a plurality of longitudinal passageways so that air can be forced in one end of these passageways to flow through the passageways and out of the other end of the passageways. On the inside of the inner vanes is a corresponding thin-walled cylindrical sleeve which also provides the support for an X-ray tube. Two power transformers, one at each end, are mounted inside the housing. The inner sleeve provides for the flow of cooling gas inside of the housing, from one end to the other end of the inner longitudinal passageways.

The ends of the housing are closed and sealed with end plates, and the interior volume is evacuated and then filled with a selected gas at a selected pressure. The gas chosen is one such as sulphur hexafluoride, the purpose of which is to provide electrical insulation and to prevent electrical breakdown through the gas inside of the housing, and also to provide improved heat transfer between the inner hot surfaces of the X-ray tube and the metal of the housing. An internal fan at one end of the housing circulates the internal gs through one power transformer, then over the X-ray tube from the cathode towards the anode, and through the second power transformer and back to the fan through the internal passageways on the inner surface of the housing. An external fan which is also partially enclosed circulates room air through the outer longitudinal passageways to carry heat away from the housing that has been transferred to it by the internal gas.

For an X-ray tube that requires 300,000 volts between the cathode and anode, two power transformers are provided, the secondaries of which are each 150,000 volts. One end of the cathode transformer provides power for the cathode heater and is electrically at a potential of −150,000 volts, while the anode is supplied with a corresponding transformer at the same time at a voltage of 150,000 volts positive, providing a total voltage between cathode and anode of 300,000 volts.

Since most of the heat developed in the X-ray tube is generated at the anode, the anode is supported by a heavy copper cylinder having longitudinal boreholes and a large plurality of wide thin radial vane on its outer surface, so that the circulating gas can pass through the boreholes and between the vanes, to carry heat away from the anode. The outer edges of the vanes ae enclosed in a cylinder which is supported inside of the inner sleeve by means of an annular baffle plate made of insulating material, such as Teflon. A series of narrow grooves is machined on the two faces of the annular plate alternating grooves on opposite sides to provide a zig-zag cross-section. This provides a greater surface path for electrical leakage and also provides for compliance in the radial direction which acts as a shock absorber to shield the X-ray tubes from serious vibration or impulsive forces.

BRIEF DESCRIPTION OF THE DRAWINGS

These and other objects and advantages of this invention and a better understanding of the principles and details of the invention will be evident from the following description taken in conjunction with the appended drawings in which.

DETAILED DESCRIPTION OF THE PREFERRED EMBODIMENTS

Figure 1:
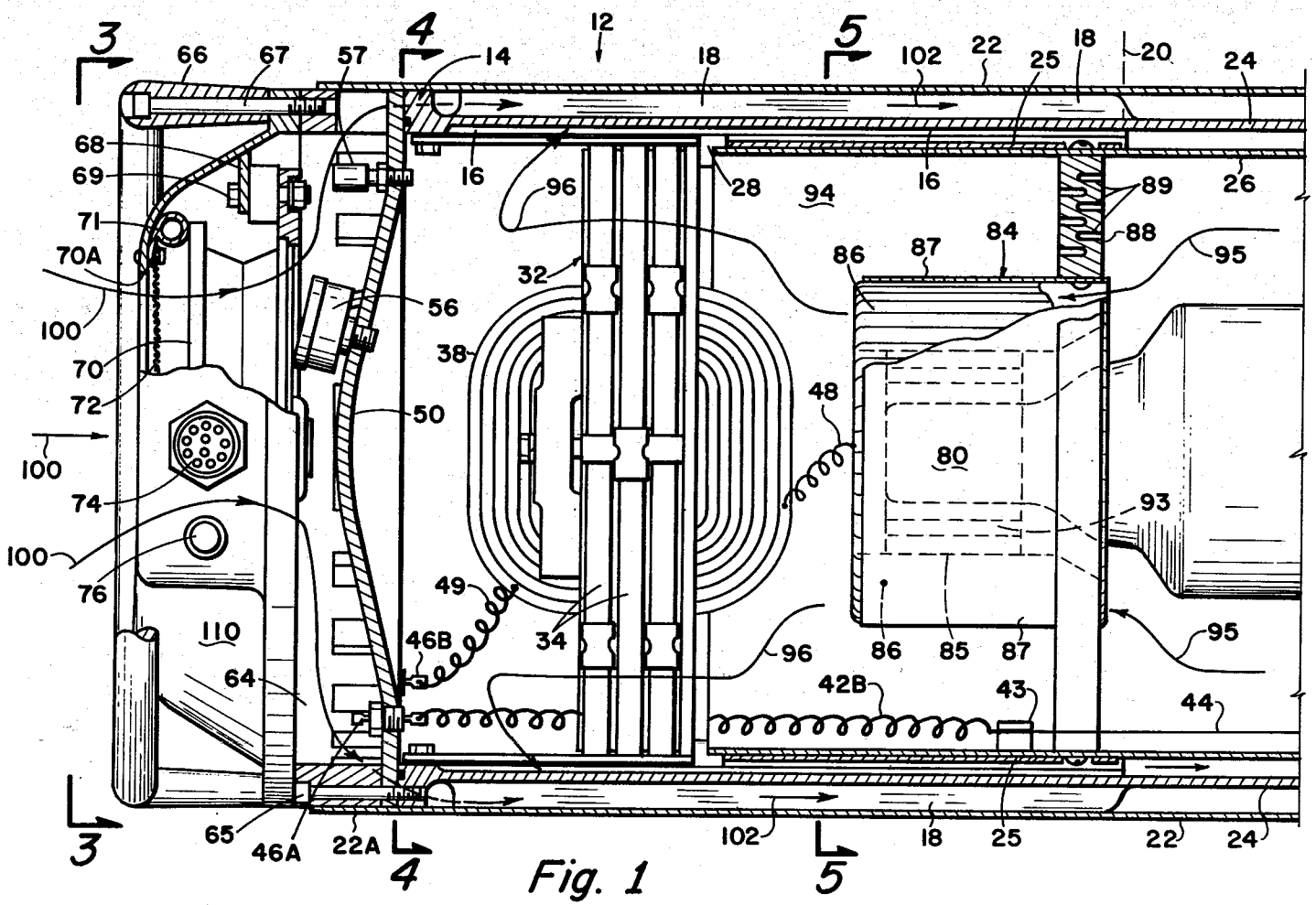
FIGS. 1 and 2 represent together a vertical cross-sectional view along a diametral plane of the apparatus of this invention.
Figure 2:
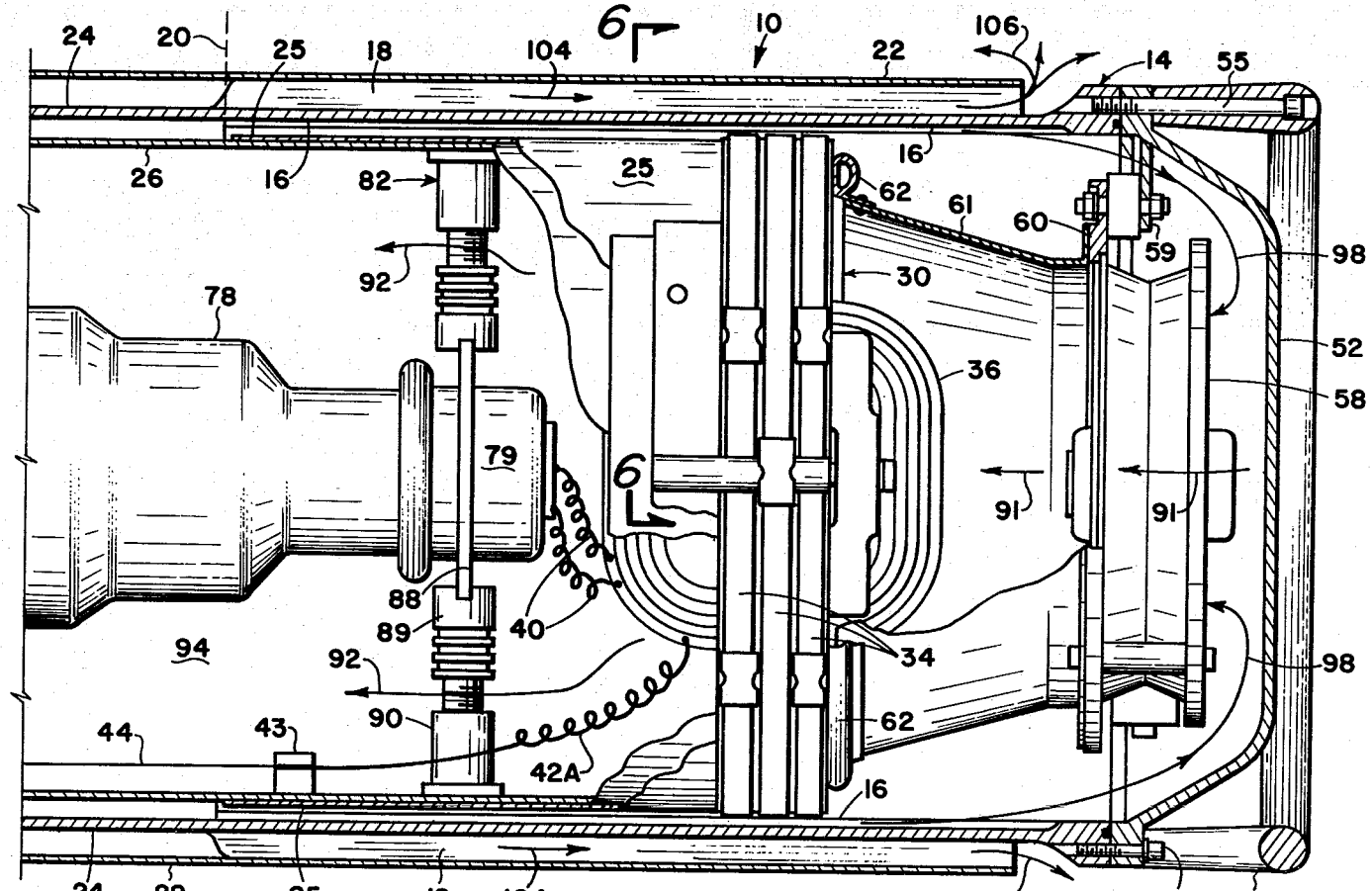

Referring now to the drawings and in particular to FIGS. 1 and 2, there is shown a diametral cross-section of the apparatus of this invention. Indicated generally by the numerals 10 at the cathode end, and 12 at the anode end.

The principal member of the device is a housing, indicated generally by the numeral 14, which comprises a thick-walled cylindrical tube of selected diameter, length, and wall thickness. The inner surface is machined with a plurality of grooves 16A shown in FIGS. 4, 5, and 6 in better detail. These extend almost completely from one end to the other leaving only a hub portion at each end of the original thickness of the metal. Similarly, the outer surface of the housing is machined with a corresponding plurality of deeper grooves 18A with intervening radial ridges 18. These extend from near one end completely to the other end except for the two hub portions. A thin-walled outer cylindrical sleeve 22 is provided which closely fits the outer edges of the ridges or vanes and covers them completely from a first end, at the anode end of the device, almost to the second end where they are uncovered.

An inner thin-walled cylindrical sleeve slightly smaller in diameter than the internal ridges or vanes, provides a framework for supporting on its interior surface the X-ray tube. This inner sleeve is shorter than the housing so as to provide space for two power transformers 30 and 32, each of which provides a secondary potential of approximately 150,000 volts. The cathode transformer also has an additional winding providing a voltage sufficient for the cathode heater of the X-ray tube. The primary voltage is such as to be the same as conventional electrical power available at the work site, such as, for example, 120 volts 60 Hz. The two transformers are separately supported inside of the housing and provide support means for the internal sleeve carrying the X-ray unit.

An intermediate portion of the length of the external vanes and internal vanes are cut-away, down to an intermediate thin-walled cylindrical form, which constitutes the principal support of the housing. The purpose of cutting away the vanes is to provide a port for the X-ray tube that will have a minimum mass of metal to interfere with the X-ray beam. At the ends of the inner sleeve it is convenient and desirable to provide a thin lead cylindrical sleeve so as to provide protection against X-rays over the covered area.

The cylindrical housing is enclosed and sealed by means of O-rings, by two end plates 52 at the cathode end and 50 at the anode end. These are bolted to the end hubs of the housing. Additionally, circular handles 54 and 66 are provided at the two ends of the enclosed housing, for the purpose of handling the unit. These are attached by bolts such as 55 and 67 respectively.

At the cathode end, inside of the sealed housing, is mounted to the end plate 52 a fan 58 which is shrouded by means 61 and sealed by means 62, so as to circulate the internal gas inside the space 94, through the fan, past the first power transformer 30, in accordance with arrows 91 and 92, then over the X-ray tube 78 having a cathode end 79, facing the transformer 30, and around the anode fixture indicated generally by the numeral 84 and through the longitudinal boreholes 93 and the vanes 86, then past the second or anode transformer 32, and then into the inner longitudinal passageways 16, back to the inlet of the fan 58. Thus the internal gas in the space 94 picks up heat from the cathode transformer 30 and the X-ray tube, and particularly the anode of the X-ray tube, the anode transformer 32, and then flowing through the longitudinal passageways 16 gives up its heat to the metal of the housing 14. The cooled gas then returns to the fan and repeats the operation.

At the anode end of the housing is a metallic ring or spacer 64, which supports an enclosure 110. This has a central opening covered by a screen 72 and supports on its inner surface the external fan which takes room air in accordance with arrows 100 and passes it through the fan and into one end of the longitudinal passageways 18 in the outer wall of the housing, along the length of the housing, and out the other end of the passageways, in accordance with arrows 102, 104, and 106. Thus the external fan which is entirely a part of and enclosed within the housing structure provides a means for cooling the housing by forcing cool room air through the outer longitudinal passageway.

Further minor details of certain portions of this assembly of FIGS. 1 and 2 will be clarified in description of other figures.

Figure 3:
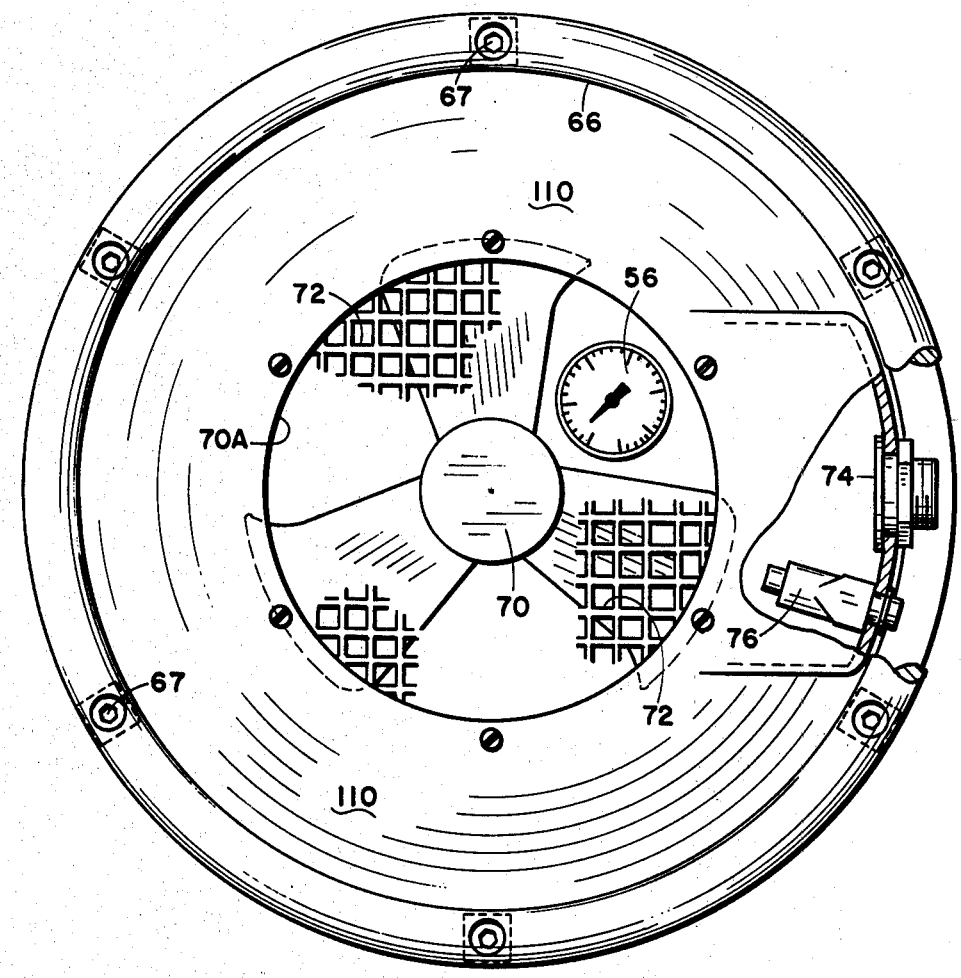
FIG. 3 illustrates an end view of the apparatus of FIG. 1, taken across plane 3—3 of FIG. 1.

Referring now to FIG. 3 and also to FIG. 1, there is shown an external view of the anode end of the X-ray machine taken across the plane 3—3 of FIG. 1. Clearly shown is the handle 66, the closure plate 110, the central opening 70A in the enclosure, covered by screen 72, and fan 70. Also shown as part of the enclosure is an electrical plug 74 which provides the electrical power to the unit, and a signal light 76.

Figure 6:
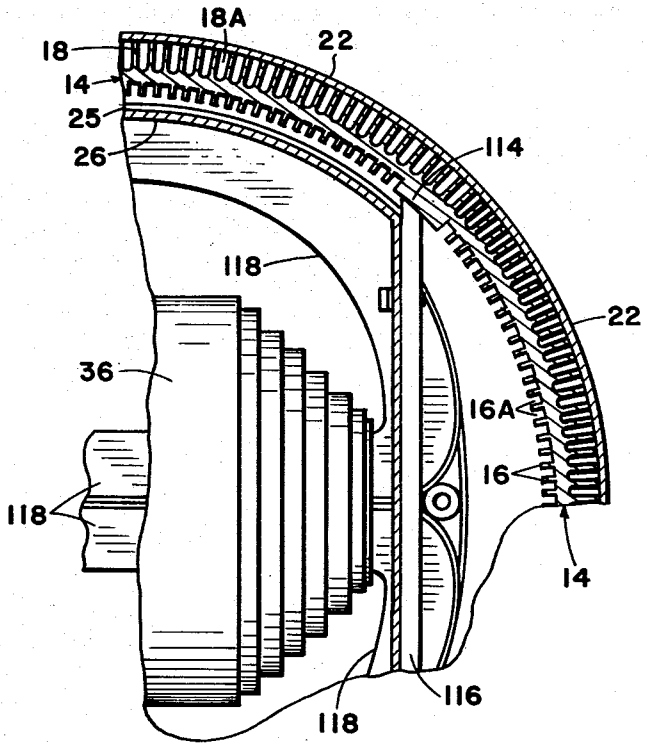
FIG. 6 is a partial cross-section taken across the plane 6—6 of FIG. 2.
Figure 4:
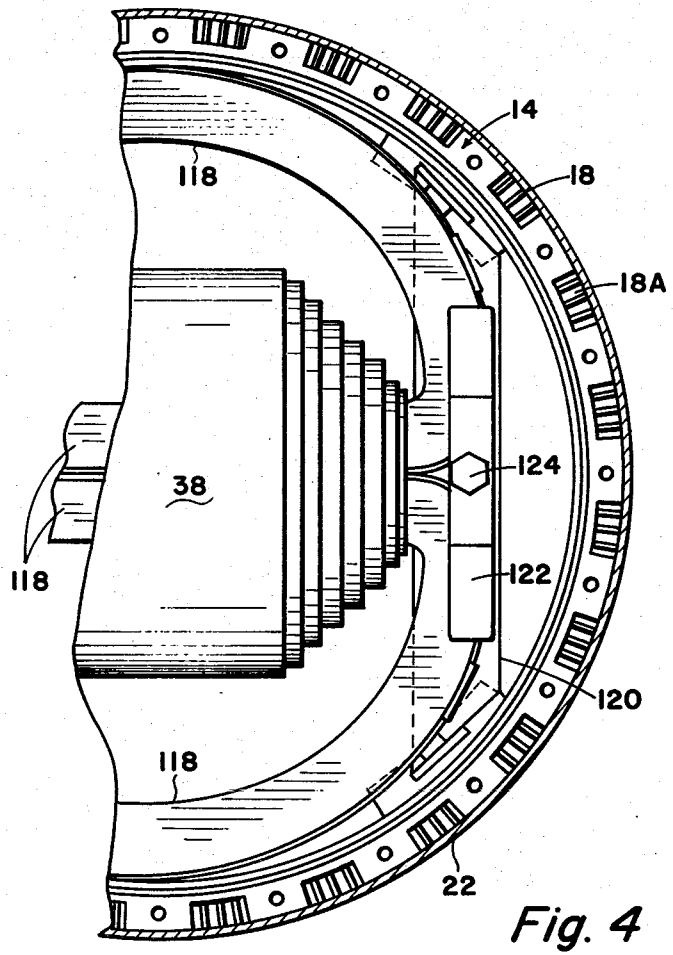
FIG. 4 is a partial cross-section taken across the plane 4—4 of FIG. 1.
Figure 5:
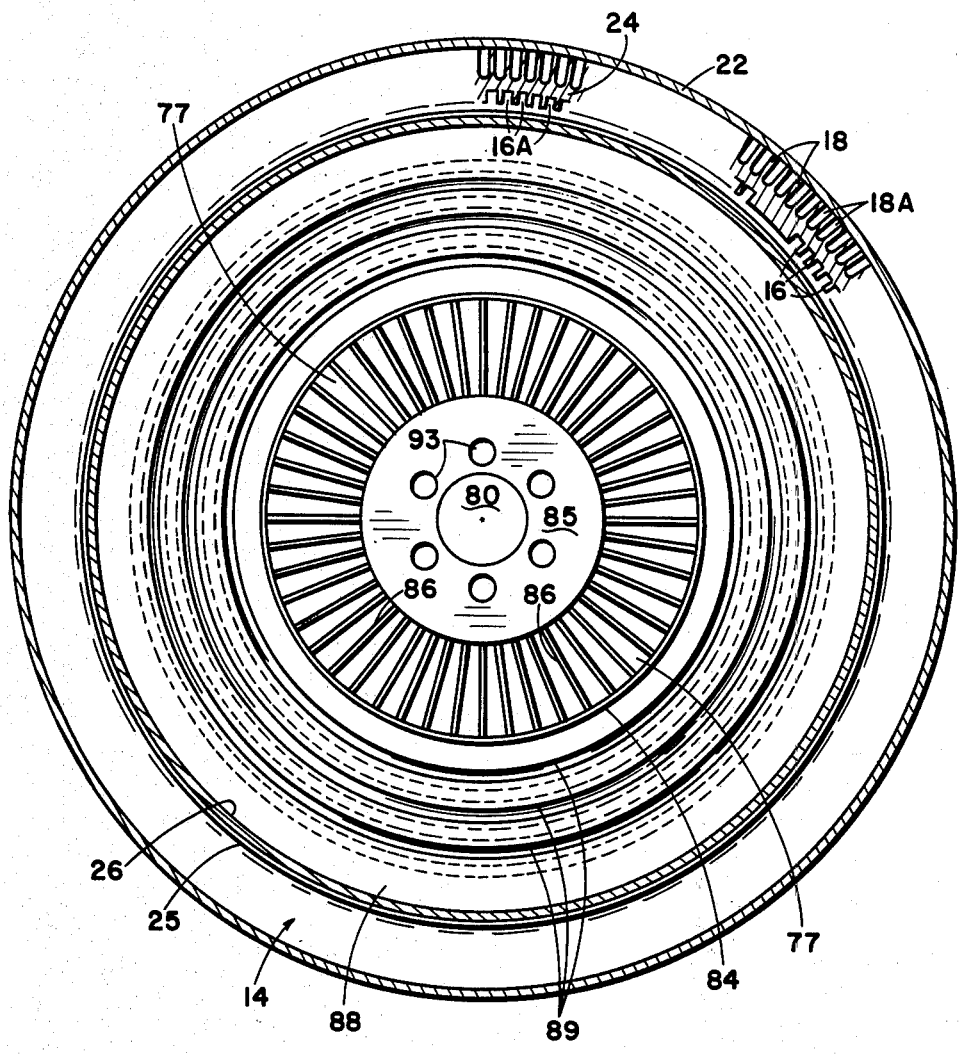
FIG. 5 is a cross-section taken across the plane 5—5 of FIG. 1 showing, in particular, the apparatus for mounting the anode end of the X-ray tube.

Referring now to FIGS. 4, 5, and 6, there are shown partial cross-sections through the housing taken along the planes 4—4, 5—5, and 6—6, respectively. Clearly shown in FIGS. 4 and 6 is the construction of the power transformers which comprise two "D"-shaped cores 118, with a central winding 38 for the anode transformer and 36 for the cathode transformer. These are supported by brackets in any selected manner inside of, and supported by, the housing. These transformers are non-enclosed so that the internal cooling and insulating gas in the space 94 can flow through the transformer over the cores and the windings to cool them, etc.

A clear view is shown of the cross-section of the housing in FIG. 6 showing the internal grooves 16A and intervening vanes 16, the inner sleeve 26 and the lead shield 25. On the outer surface of the housing are corresponding grooves 18A and intervening vanes 18, which are covered by the outer sleeve 22, forming individual longitudinal passageways. In machining the inner grooves, pads such as 114, are left intact, at full thickness, so as to provide support for the corresponding brackets 116, and so on.

FIG. 4 shows the end of the hub view of the housing 14. At the anode end, external grooves are cut in this hub inbetween bolt holes so as to provide for the flow of external air through the hub and into the corresponding passageways 18A. Also shown are brackets 120 with clamps 122 and bolt 124 to clamp the transformer core 118 to the brackets 120, and so on. Such details are, of course, at the selection of the designer and are not the principal factors and advantages of the design.

Referring now to FIG. 5 and to FIG. 1, there is shown a cross-section of the apparatus across the plane 5—5 of FIG. 1. This shows in clear detail the anode end 80 of the X-ray tube which fits into an anode receptacle 85, which is a block of very high heat conductive metal such copper.

Surrounding and supporting the anode fixture 85 is a transverse annular plate 88 made of high electrical resistive material, such as Teflon. This has a plurality of circular grooves 89 spaced radially out across the annular plate. Alternate grooves are cut from opposite sides to provide a sort of zig-zag or bellows-type construction which would have some springiness in the radial direction so as to take the shock of radial shock forces on the X-ray tube. Also, the grooves serve to increase the length of surface path between the high potential anode at 150,000 volts, above the grounded housing. Also shown in FIG. 5, of course, is the external sleeve 22, the internal sleeve 26, and the lead shielding 25. Only a portion of the outer grooves 18A and inner grooves 16A are shown, for convenience.

Figure 8:
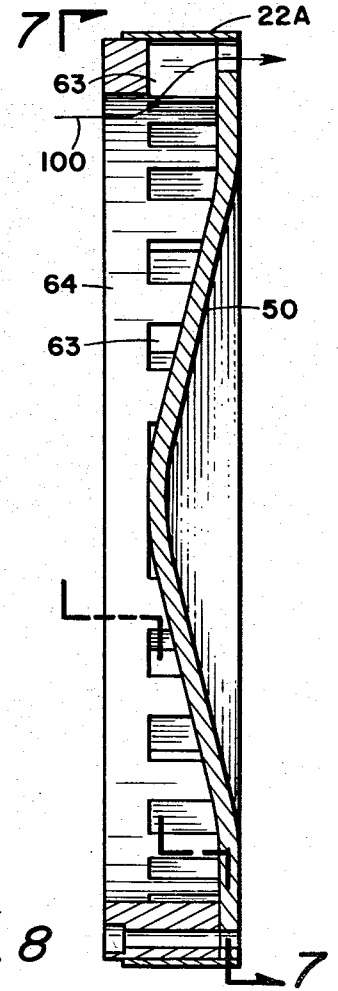
FIGS. 7 and 8 show two cross-sections of the end plate at the anode end of the apparatus of FIG. 1.
Figure 7:
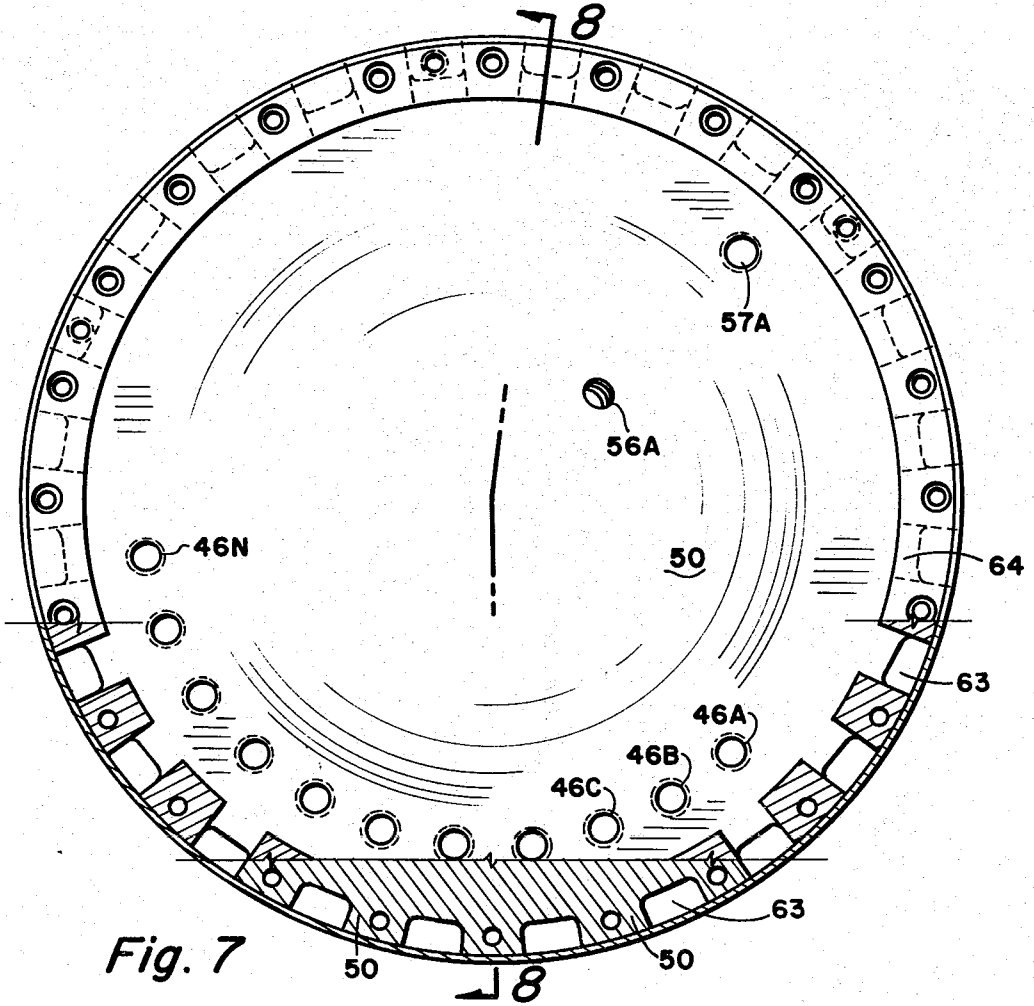

Referring now to FIGS. 7, 8, and 1, there is shown a detail of the end ring or spacer 64 which clamps end plates 50 to the housing and also supports the enclosure 110 and the handle 66. FIG. 7 is a cross-section taken across the plane 8—8 of FIG. 7.

There are a group of notches 63 cut in one end of the ring 50. These are spaced circumferential to be exactly at the position of the corresponding notches in the plate 50, so that air from the external fan can flow in accordance with arrows 100 through the notches in the ring 64 and through the notches in the plate 50 and into the outer longitudinal passageways. The outer circumference of the ring 50 is covered by an outer sleeve 22A so as to prevent the air flowing in accordance with arrows 100 passing out through the outer wall of the ring. The outer ring 22A corresponds in thickness and diameter to the sleeve 22 which encloses the housing.

In FIGS. 7 and 1 there is shown some detail such as a pressure gauge 56 which fits into the threaded opening 56A which displays the pressure of the gas inside of the space 94. Also, there is a valve 57 which is threaded into a tapped opening 57A. This valve is used for filling the selected gas into the interior volume of the housing.

Also, there are a plurality of lead-in insulated terminals 46A, 46B, etc. which are fitted into corresponding threaded openings in the plate shown as 46A, 46B, 46C, . . . 46N. Leads from each of the electrical units in the interior of the housing are carried by leads such as 40 from the coil 36 to the cathode 79, and leads 42A from the coil 36 to an insulating post 43 which supports an aluminum rod 44 across the window where the beam of the X-ray tube is directed, to a second insulating post 43 and lead 42B to the terminal 46A. Similarly, there is a lead 48 from the secondary terminal of the coil 38 to the anode and a second lead 49 from the secondary to the lead through connector 46B. Not shown are the primary connections of the two transformer coils which go to additional lead-through connectors, and so on. Also, the internal fan power leads go by way of rods such as 44 to corresponding terminals 46.

The cathode end 79 of the X-ray tube 78 is supported in a metal ring 88, which is held in insulating posts indicated generally by the numeral 82. There are a plurality of these, equally spaced circumferentially. Each post combines a threaded insulating post in a threaded insulating cup, so that the tube can be properly centered in the housing and held rigidly.

What has been described is a self-contained, portable, air-cooled industrial X-ray machine having a capability for one hundred percent duty factor. The principal part of the structure is the housing, which not only provides support and protection for the X-ray tube, for the power transformers, and other equipment necessary for the operation of the device, but also serves as a gas-to-gas heat exchanger. The housing carries the heat from the transformers and X-ray tube, by means of an internal, pressurized, selected gas to the housing itself, by means of gas flow along internal longitudinal passageways. Also, the housing, having received the internal heat, is cooled by means of circulation of room air by a self-contained fan which is enclosed within the apparatus, along the external longitudinal passageways of the housing.

While the X-ray tube is illustrated as one which has an anode capable of providing a 360° radial beam of X-rays, any industrial X-ray tube having limited area ports can, of course, be used. This particular X-ray machine can be used inside of tanks, pressure vessels, or pipelines, to provide a simultaneous picture of a complete circumferential area of the wall, for example, or it can be mounted in a fixed position with relation to a travelling belt carrying parts to be radiographed and so on. No limitation is intended on the use of the device or of the type of X-ray machine which can be positioned inside of the housing.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A completely enclosed, self-contained, cooled, industrial X-ray machine having an improved X-ray tube, power supply and heat exchanger assembly, comprising:

(a) a cylindrical metallic housing of selected material, longer than said X-ray tube, a plurality of narrow longitudinal grooves with intervening narrow vanes, on the outside surface of said housing;

(b) a large plurality of narrow longitudinal grooves with intervening narrow vanes, on the outside surface; these internal and external vanes extending substantially the full length of said housing except for a portion of selected length intermediate the two ends, where said vanes are cut down to a thin-walled cylinder of selected thickness;

(c) a first thin-walled outer sleeve surrounding the outer edges of said outer vanes forming a plurality of external tubular longitudinal passageways along the outside surface of said housing, said outer sleeve extending from a first end of said housing almost to the second end, leaving a short length of said grooves uncovered;

(d) means to support two power transformers inside said housing, one at each end, for supplying high voltage to the cathode and anode respectively, of said X-ray tube;

(e) plate means to close off and seal both ends of said housing, and means to inject a selected gas at a selected pressure inside said closed housing;

(f) a conventional, commercial, X-ray tube, and support means for said X-ray tube inside of and concentric with an inner thin-walled cylindrical sleeve; and means to position said inner sleeve concentrically in said housing;

(g) internal fan means for circulating said selected gas inside of said inner sleeve past a first transformer, over said X-ray tube and past a second transformer, then through the annular space between said inner sleeve and said housing, back to said internal fan means;

(h) external fan means for blowing external air through said longitudinal passageways outside of said housing.

2. The apparatus as in claim 1 in which said X-ray tube support means at said cathode comprises an axial receptacle supported on a plurality of circumferentially spaced, radially extensible, insulating posts.

3. The apparatus as in claim 1 in which said X-ray tube support means at said anode comprises an axial receptacle having a plurality of radial vanes, said radial vanes supported by a transverse annular baffle plate made of insulating material.

4. In an industrial X-ray apparatus having a commercial X-ray tube and high voltage transformers, the improved combination housing and gas-to-gas heat exchanger, comprising;

(a) circular cylindrical tubular housing made of selected material, of selected length and diameter, and means to close and seal the two ends;

(b) a large plurality of narrow longitudinal vanes on the inside surface of said housing; and an inner thin-walled sleeve positioned inside of said vanes, providing a plurality of internal longitudinal passageways;

(c) a large plurality of narrow longitudinal vanes on the outside surface of said housing; and an outer thin-walled sleeve enclosing the outer edges of said vanes, providing a plurality of narrow longitudinal external passageways, outside said housing;

(d) means to fill said enclosed housing with a selected gas at a selected pressure;

(e) internal fan means to circulate said selected gas through said internal passageways;

(f) external fan means to circulate outside air through said external passageways; and (g) means to mount an X-ray tube inside said inner sleeve.

5. The apparatus as in claim 4 in which said internal and external vanes are removed over a port area through which said X-ray beam passes.

6. The apparatus as in claim 4 including means to mount power transformers in said housing.

7. The apparatus as in claim 6 in which the operating voltage of said X-ray tube is E volts, and said power transformers comprise two separate transformers, one at each end inside said housing, the secondary voltage at the cathode transformer being E/2 below ground, while the secondary voltage at the anode transformer is E/2 above ground.

* * * * *